United States Patent [19]

Roberts et al.

[11] 4,101,045

[45] Jul. 18, 1978

[54] CRYOGENIC CONTAINER

[75] Inventors: William Melchior Roberts, Blauvelt; Jean Kohn, New York, both of N.Y.

[73] Assignee: Baltek Corporation, Northvale, N.J.

[21] Appl. No.: 786,878

[22] Filed: Apr. 12, 1977

[51] Int. Cl.[2] ..... B65D 87/24; B63B 25/16

[52] U.S. Cl. ..... 220/404; 220/461; 220/85 B; 220/901

[58] Field of Search ..... 220/9 A, 9 LG, 10, 15, 220/63 R, 85 B

[56] References Cited

U.S. PATENT DOCUMENTS

| | | | |
|---|---|---|---|
| 3,122,000 | 2/1964 | Sirocky | 220/9 LG X |
| 3,262,628 | 7/1966 | Heisler et al. | 220/63 R X |
| 3,325,037 | 6/1967 | Kohn et al. | 220/9 LG |
| 3,356,251 | 12/1967 | Roberts | 220/63 R |
| 3,457,890 | 7/1969 | Rivas et al. | 220/9 A X |
| 3,458,084 | 7/1969 | Laurizo | 220/63 R X |

*Primary Examiner*—Stephen Marcus

*Attorney, Agent, or Firm*—Michael Ebert

[57] ABSTRACT

A cryogenic container adapted to store or transport liquified gases, the container including an outer tank formed by walls which have thermal insulation properties and are structurally capable of supporting the load, the walls incorporating a liquid and gas-impervious secondary barrier. Received within the outer tank and readily removable therefrom is a prefabricated independent inner tank constituted by a flexible bladder whose geometry roughly conforms to the contours of the inner surface of the outer tank. The bladder is formed of a synthetic plastic fabric material that is coated to render it liquid and gas-impervious to define a primary barrier, which coated fabric material maintains its flexibility and other physical characteristics at cryogenic temperatures and has sufficient structural strength to sustain the cryogenic liquid load without any danger of rupture even in those areas thereof in which the bladder does not fully conform to the contour of the outer tank surface and is not backed thereby.

13 Claims, 6 Drawing Figures

CRYOGENIC CONTAINER

BACKGROUND OF INVENTION

This invention relates generally to thermally-insulated containers for storing or shipping liquified gases at cryogenic temperatures and at atmospheric pressure, and more particularly to a cryogenic container provided with a prefabricated inner bladder whose configuration roughly conforms to the contours of the inner walls of the container and yet is capable of sustaining the liquid load without rupture.

While a container in accordance with the invention will be described in connection with liquified natural gas (LNG), it is to be understood that the container is also useful for the storage and transportation of other cryogenic liquified gases such as liquified petroleum gas (LPG), ethylene, liquified oxygen and liquified nitrogen.

The rising demand for methane or natural gas is greatest in those highly industrial countries, such as the U.S., Western Europe and Japan, which are deficient in this natural resource. In recent years, it has become the practice to liquify methane at its source and to transport the extremely cold liquified gas at atmospheric pressure to the consumer site where it must be stored.

The fact that natural gas in liquified form occupies a volume that is only one six-hundredth of the fuel in its gaseous state renders the liquefaction process economically feasible even when the liquid must be transported for thousands of miles from an oil field in Africa, the Persian Gulf or Indonesia, where it is readily available to the remote consumer market. To this end, ocean-going vessels have been specifically fitted with cryogenic containers to carry LNG cargoes.

Most LNG containers designed for transoceanic transport are of the free-standing tank or of the membrane tank type. In the usual free-standing tank arrangement, the tank rests on structural insulation material such as composite panels made of balsa wood and plywood, with non-structural insulation filling the non-loaded area. Similar thermal insulation is provided between the upstanding tank walls and the bulkhead or inner hull. Because the free-standing tank must carry a considerable liquid load and is in direct contact with the cryogenic liquid, it must be fabricated of heavy-gauge metals such as aluminum or stainless steel which are capable of carrying the load and are not subject to embrittlement and failure at cryogenic temperatures.

The membrane tank, usually formed of thin metal sheets of nickel alloy steel or material having similar properties, is supported both on the bottom and side walls by structural insulation which is attached to or supported by the ship's bulkhead or inner hull. A membrane tank of this type is disclosed in the Kohn et al. U.S. Pat. No. 3,325,037 wherein a thin metal tank is supported within a thermal insulating structure constituted by balsa-wood sandwich panels of exceptionally high structural strength. Inasmuch as a cryogenic container in accordance with the invention preferably makes use of similar insulation having structural properties, the entire disclosure of this patent is incorporated herein by reference.

In designing a cryogenic container, one must take into account the large differential expansion of the various components of the tank and ship during actual service. The extremes of temperature to which the cryogenic container are subjected will be appreciated when it is realized the liquid hydrocarbons at atmospheric pressure have a temperature of about −258° F, whereas ambient temperature may range between 0° F and +115° F.

There are several known ways by which one may impart characteristics to the walls of the membrane tank which permit these walls to resist dimensional variations as a result of extreme temperature differences without sustaining damage. Thus the walls of the tank may be made up of a welded assembly of corrugated metal plates or flat plates connected together with metallic bellows elements, the metal walls being made integral with an insulating layer.

Metal tanks of the free-standing or membrane type, particularly those of the stainless steel and aluminum alloy variety, tend to be quite costly. Moreover, the intricate expedient heretofore employed to accommodate the tank structure to extreme changes in temperature and to minimize the transmission of stresses between the inner tank and the insulation due to contraction add considerably to the expenses of producing and installing the container.

With a view to reducing the cost of cryogenic containers, the Cuneo U.S. Pat. No. 3,566,524 provides a steel-reinforced concrete tank having a liquid and gas-impervious liner of polyethylene at its inner wall. Inasmuch as this liner has little structural strength, it is vital that the liner conform intimately to the contours of the inner surface of the concrete tank, for otherwise should spaces exist between the polyethylene film and the tank surface, the unsupported load imposed by the cryogenic liquid on the liner will cause rupture thereof.

Hence though a polyethylene liner is less expensive than a metal membrane tank in terms of material costs, the expenses involved in producing and installing a perfectly contoured polyethylene liner are considerable and offset to a large degree the savings in material costs.

Similarly, in the Alleaume U.S. Pat. No. 3,273,373, a cryogenic tank is provided with a liner formed of a homogeneous, flexible and elastic material which, though it serves as a primary barrier, lacks structural properties and is incapable of physically supporting a heavy liquid load.

For membrane tanks, government regulations now require both a primary and secondary barrier layer to ensure that the liquid methane makes no contact with the ship's hull or bulkhead; for should the extremely cold liquid penetrate the primary barrier and find its way to the relatively warm metal of the hull or bulkhead, it will embrittle and fracture this metal. The primary barrier layer must be designed to securely contain the LNG or other cryogenic liquid, whereas the secondary barrier acts as a safety factor in the event of a failure in the primary barrier.

Thus while various forms of cryogenic containers have heretofore been proposed employing as a primary barrier an inner liner of Mylar, fiberglass or other non-metallic material, in all such containers it is essential that this liner which lacks structural properties and is incapable of supporting the load be in intimate contact with the inner wall of the insulation layer so that the liner is backed up throughout its entire area. The existence of any irregularity between the liner and the inner wall cannot be tolerated for a discontinuity at any given point will deprive the liner of its backing and may result in a rupture thereof having serious consequences.

SUMMARY OF INVENTION

In view of the foregoing, it is the main object of this invention to provide a cryogenic container having an independent and removable inner tank constituted by a prefabricated flexible bladder whose geometric configuration roughly conforms to the contours of the inner walls of an outer tank within which it is received.

A significant feature of the invention is that the inner tank serves as a primary liquid and gas-impervious barrier and the outer tank as a secondary barrier, the inner tank being formed of a coated synthetic fabric material which is structurally capable of supporting the liquid load even in those areas where the bladder does not fully conform to the contours of the inner surface of the outer tank and is not backed thereby.

Inasmuch as the wall of the bladder is not bonded to the inner surface of the outer tank and there is no need to precisely conform the geometry of the bladder to that of the outer tank, the cost of producing and installing a cryogenic container in accordance with the invention is substantially lower than that of containers of the type heretofore known. Moreover, it becomes possible to fabricate the bladder at a factory site remote from the container installation under careful quality-control conditions.

Should it be necessary to make repairs on the bladder, this can be done inexpensively and with no greater difficulty than when fixing a flat tire on a car. And because the inner bladder is not bonded to the insulating walls of the outer tank, these insulating walls may be readily inspected and repaired simply by folding or moving the empty bladder away from the walls of the outer tank or removing the bladder altogether. Furthermore, a flexible bladder greatly enhances access to the secondary barrier for purposes of inspection and repair.

With existing tank membrane systems, differential thermal contraction of the membrane and the surrounding insulation is compensated for either by careful selection of materials to minimize these differences, which may impose other compromises or an increased price; or by incorporating expansion joints at various points in the membrane, thereby greatly complicating the manufacturing procedure. These known techniques require secure and permanent connections between the insulation layer and the membrane. But in an independent bladder arrangement in accordance with the invention, there need be no connection or only temporary or flexible connections between the bladder and the surrounding insulation, thereby eliminating problems arising from the transmission of stresses from the membrane to the insulation due to contraction.

Briefly stated, these objects are accomplished in a cryogenic container including an outer tank formed by walls preferably constituted by sandwich panels having a balsa-wood core. The panels possess thermal insulation properties and are capable of supporting the liquid load, the panels incorporating a liquid and gas-impervious secondary barrier.

Received within the outer tank and readily removable therefrom is an independent, prefabricated inner tank constituted by a flexible bladder whose geometry roughly conforms to the contours of the inner surface of the outer tank. The bladder is formed of a synthetic plastic fabric material which is preferably a long chain polyamide fiber that is coated with a compatible material to render it liquid and gas-impervious to define a primary barrier. The coated fabric maintains its flexibility and other physical characteristics at cryogenic temperatures and has sufficient structural strength to sustain the liquid load without any danger of rupture even in those areas in which the bladder does not fully conform to the contour of the outer tank and is not backed thereby.

OUTLINE OF DRAWING

For a better understanding of the invention as well as other objects and further features thereof, reference is made to the following detailed description to be read in conjunction with the accompanying drawings, wherein.

DESCRIPTION OF INVENTION

Figure 1:
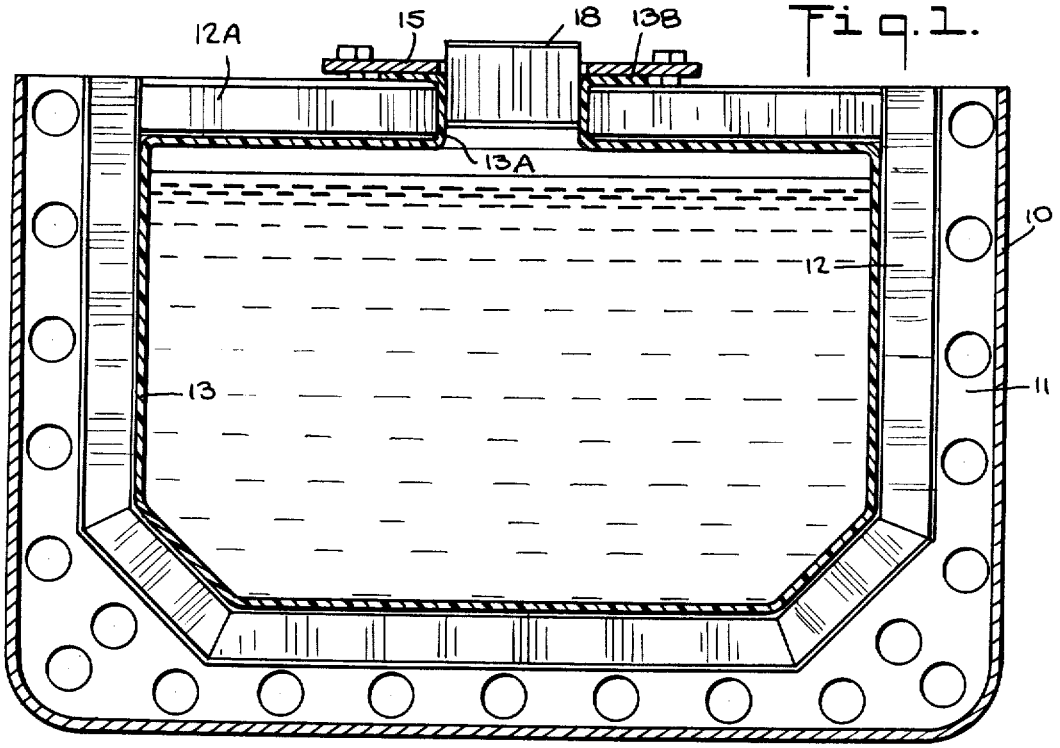
FIG. 1 is a transverse section taken through a cryogenic container formed in the hull of a vessel and incorporating a prefabricated inner tank in accordance with the invention.
Figure 2:
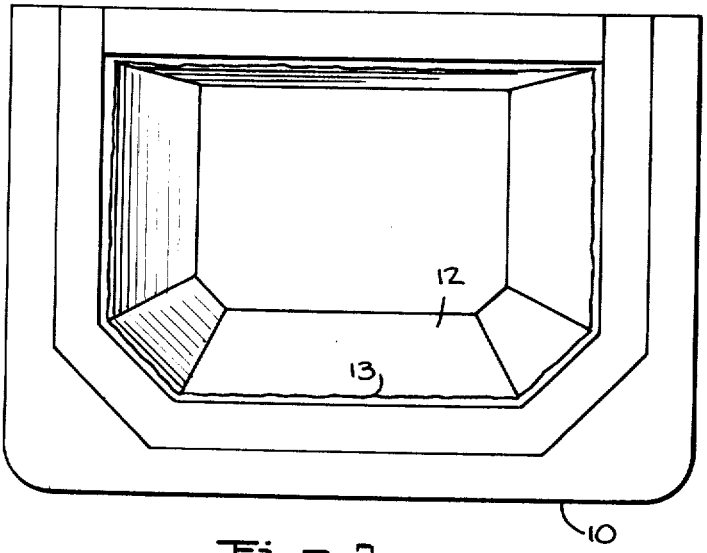
FIG. 2 is a perspective view of the interior of the container.

FIGS. 1 and 2 show the basic structure of a cryogenic container in accordance with the invention for use in a cargo vessel having a metal hull 10 and a reinforcing frame 11 which defines a prismatically-shaped hold. The container includes an outer tank 12 formed by insulating panels which are mounted on the walls of the hold and surround an independent inner tank 13 to maintain the extremely cold temperature of the cryogenic liquid load contained therein.

The cargo container shown herein is by way of illustration only, with the hull of the ship, in this instance, representing the shell or casing of the outer tank. In the case of a cryogenic shipping crate, the outer shell could be formed by a thin aluminum skin, and in the case of a storage container for liquid methane, the outer shell may be cast of concrete or other material suitable for a stationary installation.

Panels 12 not only serve as thermal insulation for the liquid container in inner tank 13, but also function as a secondary barrier therefor. They must also be able to withstand the mechanical forces imposed thereon by the liquid load in the course of transit.

Figure 6:
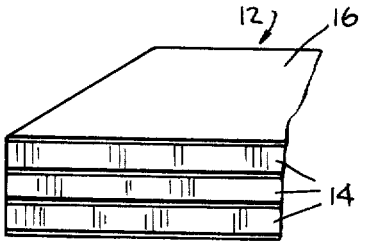
FIG. 6 is a partial view of one of the insulating panels forming the inner tank.

As best seen in FIG. 6, each of panels 12 is constituted by a multi-layer core 14 of end grain balsa wood, one surface of which is laminated to an inner facing plate 15 exposed to the cryogenic temperature, the other surface of the core being laminated to an outer facing plate 16 exposed to ambient temperature. The cryogenic temperature is that of the liquid methane load, while the ambient temperature is that of water with respect to that portion of the container in contact with the submerged portion of the hull and that of air with respect to that portion of the container in contact with the area of the hull above the water line.

The balsa wood layers of core 14 are bonded together with a suitable adhesive such as phenol-resorcinol formaldehyde. This adhesive is applied as a liquid resin which when cured affords the desired bond between the layers of balsa. A more detailed description of the exceptional structural strength and remarkable thermal insulating properties of these balsa wood panels is set forth in the above-identified Kohn et al. patent. In practice, the cost of the panels may be reduced without any significant loss in thermal insulation properties by the use of a core formed by spaced beams of balsa interspersed with beams of foam plastic material.

Structurally, end grain balsa wood panels do not warp; for each cell of the balsa is comparable to an independent column. These columns draw uniformly closer together with contraction of the facing sheets and move uniformly apart with expansion thereof. Even though the panels are lightweight, they are structurally so strong as to make it possible to build the outer tank of a cryogenic container in accordance with the invention with a relatively weak outer shell and without reinforcing ribs, relying mainly on the panels to impart the necessary strength to the container.

The invention is, however, not limited to balsa wood panels, and in practice, the insulation may be provided by PVC foam, polyurethane foam, or other suitable insulation materials having adequate strength to transmit the hydrostatic and hydrodynamic loads of the tank to the ship's structure.

Inner tank 13 is constituted by a collapsible flexible bladder formed of a synthetic plastic fabric material which is coated with a compatible material to render it liquid and gas-impervious so that the bladder acts as a primary barrier. Bladder 13 is provided with an inlet neck 13A that is dimensioned to pass through a port 14 in the upper wall 12A of the outer tank. The upper end of the neck terminates in a flange 13B which lies against the outer surface of the top wall.

Flange 13B is clamped to the top wall by a ring 15 which is bolted or otherwise secured to top wall 12A of the outer tank. Thus the independent inner tank or bladder 13 is suspended by its neck from the top wall of the outer tank. The opening may be closed by a conventional hatch cover 18 similar to that used on other ships or containers of this type. Or the cover may take the form of a balsa wood panel of the type previously described.

Figure 3:
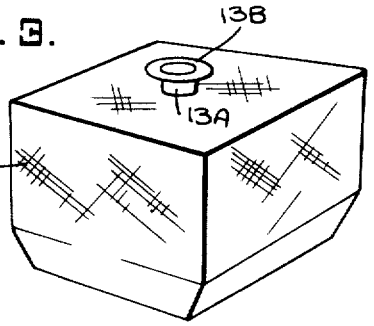
FIG. 3 is a separate perspective view of the inner tank.

The inner configuration of the outer tank defined by panels 12 has a prismatic form which corresponds to the shape of the hold of the vessel, while the geometry of the bladder, as best seen in FIG. 3, roughly conforms to the contours of the inner surface of the outer tank. However, the bladder has sufficient strength to support the liquid load; hence irregularities between the inner and outer tank geometries are tolerable. If, therefore, any area of the bladder fails to conform to the outer tank surface to create a space therebetween, the lack of back support at this point will not cause rupture of the bladder.

Figure 5:
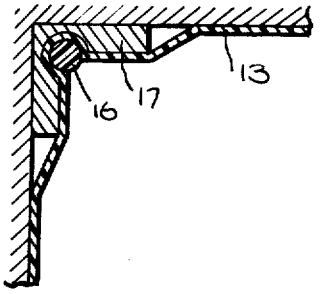
FIG. 5 illustrates one manner of temporarily attaching the inner tank to the inner wall of the outer tank.

Since the independent bladder is formed of flexible fabric material, it may be collapsed and lowered into the outer tank through port 14 in the top wall thereof. When the bladder is filled with liquid, it will then be caused to assume its normal shape. However, it may be desirable before filling the bladder to prevent its collapse. For this purpose, the corner edges of the bladder, as shown in FIG. 5, may be anchored by a spline 16 formed of flexible and resilient material having acceptable cryogenic properties in long channels 17 secured to the corners of the outer tank. Alternatively, the bladder may be provided at selected positions with loose strings that may be tied to hooks secured to the inner walls of the outer tank.

It is essential that the fabric material from which the bladder is made be capable of withstanding cryogenic temperatures without any adverse effect on its flexibility or other physical properties. Also, the material must be non-reactive with the cryogenic liquid and of sufficient strength to structurally support the liquid load.

For this purpose, the fabric may be woven or otherwise fabricated from nylon, polyester or Dacron, the latter being a polyester fiber made from polyethylene terephthalate. Dacron has exceptional tensile strength as well as high elastic recovery. It is difficult to ignite and self-extinguishing. The preferred material for the bladder fabric is Kelvar, which is an aramid fiber formed from a long chain synthetic polyamide in which at least 85% of the amide linkages are attached directly to aramatic rings.

Figure 4:
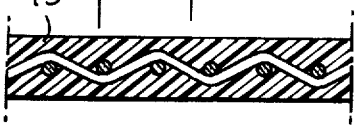
FIG. 4 is a longitudinal section taken through the material of the outer tank.

As shown in FIG. 4, the woven fabric 13A is coated with a film layer 13B which acts to render it liquid and gas-impervious. This film must be compatible to and adherent with the fabric. In practice, it may be a fluorocarbon polymer such as TFE, a silicone rubber elastomer, or Vitron, so that the flexibility of the coated material is maintained at −260° F.

The outer tank must necessarily be constructed at the ship site, for this tank conforms to and is mounted within the hold of the vessel. But the independent inner tank may be manufactured at a factory remote from the ship. Once the outer tank and the insulation system therein is complete, the bladder can then be lowered through the port in the outer tank and suspended only from the neck, or it may have a few tie-down restraints, as previously mentioned. This procedure greatly reduces the need for on-site construction labor and also makes possible a high order of quality control, for the complete bladder may be carefully checked and tested at the factory prior to its installation at the ship.

While there has been shown and described a preferred embodiment of a cryogenic container in accordance with the invention, it will be appreciated that many changes and modifications may be made therein without, however, departing from the essential spirit thereof.

We claim:

1. A cryogenic container for storing or shipping a liquified gas, such as LNG, at atmospheric pressure, in quantities comparable to those carried by LNG containers designed for transoceanic transport, said container comprising:

A. an enclosed rigid outer tank having structural walls which afford thermal insulation and incorporate a non-metallic secondary liquid and gas-impervious barrier, the inner surface of the outer tank having a predetermined configuration, the top wall of said outer tank having an inlet port;

B. an independent tank for containing a load of liquified gas and constituted by a collapsible bladder of flexible material which may be lowered in the collapsed state into the rigid outer tank through said port and which includes a neck portion that lines said inlet port, said bladder when lowered into said outer tank being suspended from said neck portion, said bladder material being constituted by a fabric of synthetic plastic fibers coated with a compatible film having sufficient strength to support said liquified gas and operative as a primary barrier, said bladder having a geometry roughly conforming to said inner surface configuration whereby those areas of the bladder which fail to exactly conform to the inner surface and are therefore unsupported are not subject to rupture by forces imposed by said load, and C. detachable means at selected positions to anchor said collapsible inner tank on the wall of the outer tank to maintain the normal shape of said collapsible tank when it is empty.

2. A container as set forth in claim 1, wherein said structural walls are formed by sandwich panels havin a balsa wood core.

3. A container as set forth in claim 2, wherein said core is constituted by at least two layers of balsa wood which are bonded together by a film of synthetic plastic material forming said secondary barrier.

4. A container as set forth in claim 3, wherein said balsa layers are in an end grain formation.

5. A container as set forth in claim 2, wherein said panels are mounted on the walls of the hold of a vessel to define said outer tank.

6. A container as set forth in claim 2, wherein said panels are mounted within a shell to define said outer tank therewith.

7. A container as set forth in claim 6, wherein said shell is of thin aluminum.

8. A container as set forth in claim 1, wherein said fabric is woven from a polyester material.

9. A container as set forth in claim 1, wherein said fabric is coated with a silicone-rubber elastomer.

10. A container as set forth in claim 1, wherein said fabric is woven from an aramid fiber.

11. A container as set forth in claim 1, wherein said bladder is provided with a neck that lies within said port and is provided with an upper flange that lies against the top wall of the outer container whereby said bladder is suspended within said outer tank by said neck.

12. A container as set forth in claim 11, further including a ring secured to said top wall to clamp said flange thereto.

13. A container as set forth in claim 11, further including a hatch cover receivable within said neck.

* * * * *